United States Patent [19]

Miyazaki et al.

[11] Patent Number: 4,903,657

[45] Date of Patent: Feb. 27, 1990

[54] APPARATUS FOR AND METHOD OF CONTROLLING INTERNAL COMBUSTION ENGINES

[75] Inventors: Masaaki Miyazaki; Shinji Kojima; Hajime Kako, all of Hyogo, Japan

[73] Assignee: Mitsubishi Denki Kabushiki Kaisha, Tokyo, Japan

[21] Appl. No.: 309,577

[22] Filed: Feb. 13, 1989

[30] Foreign Application Priority Data

Feb. 12, 1988 [JP] Japan ..... 63-31193
Feb. 12, 1988 [JP] Japan ..... 63-31194
Feb. 12, 1988 [JP] Japan ..... 63-31195

[51] Int. Cl.[4] ..... F02D 41/04; F02D 41/06; F02D 41/16

[52] U.S. Cl. ..... 123/339; 73/115; 123/478; 123/488; 123/491; 123/494

[58] Field of Search ..... 123/339, 478, 480, 488, 123/491, 494, 179 L; 73/115, 116, 117.3

[56] References Cited

U.S. PATENT DOCUMENTS 3,931,808 1/1976 Rachel .
4,131,088 12/1978 Reddy ..... 123/494
4,165,650 8/1979 Weissler II ..... 73/115 X
4,388,825 6/1983 de Valpillieres ..... 73/115
4,416,239 11/1983 Takase et al. ..... 123/494 X
4,475,381 10/1984 Nakatomi et al. ..... 73/115
4,590,563 5/1986 Matsumura et al. ..... 123/488 X
4,600,993 7/1986 Pauwels et al. ..... 123/488 X
4,787,043 11/1988 Zimmerman et al. ..... 123/480 X

*Primary Examiner*—Tony M. Argenbright
*Attorney, Agent, or Firm*—Sughrue, Mion, Zinn, Macpeak and Seas

[57] ABSTRACT

An apparatus for controlling the operation of an engine based on the pressure in an intake manifold. If a change in the pressure in the intake manifold is equal to or less than a predetermined value during a predetermined period within the period from the time when a voltage source is turned on to the time when a starter is turned on, the pressure in the intake manifold is detected and stored. If the engine is not in the start mode, the rate of fuel supply is increased based on an atmospheric pressure detection value. Based on the comparison between the atmospheric pressure value and a predetermined value, a passage for bypassing a throttle valve is opened and closed to control the idling of the engine.

12 Claims, 10 Drawing Sheets

APPARATUS FOR AND METHOD OF CONTROLLING INTERNAL COMBUSTION ENGINES

BACKGROUND OF THE INVENTION

1. Field of the Invention:

This invention relates to an apparatus for and methods of controlling internal combustion engines wherein a pressure sensor for detecting the pressure in an intake manifold is used to detect the atmospheric pressure, thereby eliminating any sensor for detecting the atmospheric pressure.

2. Description of the Prior Art:

In conventional apparatus for controlling engines, there has hitherto been used an electronical control for controlling the engine operation depending upon parameters, such as engine rotational frequency, intake manifold pressure, throttle opening, atmospheric pressure, etc. For such control, it has been achieved that the intake manifold pressure, or the pressure in a suction passage downstream the throttle valve for limiting the rate of air suction to the engine is detected by a pressure sensor in the form of the absolute pressure.

In a fuel control apparatus for an engine, for example, a decision for a mode of the engine operation, i.e., whether or not the engine is in its enrich mode operation, is made dependent upon the atmospheric pressure detected by the atmospheric pressure sensor, thereby deciding the duration of a pulse corresponding to the rate of fuel injection to be supplied to the engine. In an idling control apparatus for an engine in which the atmospheric pressure is detected to control the opening and closure of a bypass passage for bypassing the throttle valve, the opening and closure of the bypass passage is also controlled in response to changes in the atmospheric pressure detected by the aforementioned atmospheric pressure sensor, when the engine is driven in its idling operation.

Thus, the conventional engine control apparatus have problems of the necessity for separate atmospheric pressure sensor in addition to the sensor for detecting the intake manifold pressure, resulting in the apparatus itself being expensive.

SUMMARY OF THE INVENTION

The present invention is made to solve the abovementioned problems of the prior art.

It is an object of the invention to provide an apparatus having a low cost structure and for controlling an engine dependent upon a value of the atmospheric pressure which is correctly and precisely detected without using separate atmospheric pressure sensor.

For attaining this object, an apparatus for controlling an engine according to the present invention comprises pressure detecting means for detecting the intake manifold pressure in the form of the absolute pressure, cranking detecting means for detecting that a starter has turned on, pressure change detecting means for detecting that the amount of change in pressure is equal to or less than predetermined value during a predetermined period of time within the period from the time when voltage source is turned on to the time when the cranking detecting means detects that the starter is on, and memory means responsive to a detection signal from the pressure change detecting means for storing a pressure signal as an atmospheric pressure detecting value, whereby the engine is controlled on the basis of an output signal of the memory means.

Accordingly, if the pressure signal does not correspond to the atmospheric pressure and the amount of change in pressure does not exceed the predetermined value, as seen when the electric source is cut off, the memory means does not store any pressure signal from the pressure sensor as the atmospheric pressure detection value, but stores, as the atmospheric pressure detection value, only the pressure signal immediately before the engine starts, which ensures correct detection of the atmospheric pressure and highly precise and correct control of the engine.

Another object of the present invention is to provide a fuel supply control apparatus in which the rate of fuel injection is determined in accordance with the atmospheric pressure without using any additional atmospheric pressure sensor.

For attaining this object, a fuel supply control apparatus according to the present invention comprises pressure detection means for detecting the intake manifold pressure, cranking detecting means for detecting that a starter has been turned on, pressure change detecting means for detecting that the amount of change in pressure is equal to or less than a first predetermined value during a predetermined period of time within the period from the time when a voltage source is turned on to the time when the cranking detecting means detects that the starter is on, memory means for storing a pressure signal of the pressure detecting means as an atmospheric pressure detection value when the amount of change is detected to be equal to or less than the first predetermined value, and enrich control means which decides that the engine is in the enrich mode to allow the supply of fuel to be increased if a pressure signal is equal to or larger than the difference between the atmospheric pressure detection value and a second predetermined value when the engine is in a driving mode other than the starting mode.

Accordingly, as the atmospheric pressure detection value to be used for deciding if the engine is in the enrich mode, the intake manifold pressure equal to the atmospheric pressure before the engine is rotated is detected by the pressure detecting means and read into the memory means. Therefore the rate of fuel supply can precisely and correctly be determined and a cheap fuel supply control apparatus can be provided.

A further object of the present invention is to provide an idling control apparatus of an engine for controlling the opening and closing of a bypass passage in the idling condition and having a cheap structure without using any additional atmospheric pressure sensor.

For attaining this object, an idling control apparatus for an engine comprises first means for opening and closing a bypass passage for bypassing a throttle valve, pressure detecting means for detecting the intake manifold pressure in the form of the absolute pressure, cranking detecting means for detecting that a starter has been turned on, second means for storing a pressure signal of the pressure detecting means as an atmospheric pressure detection value when the amount of change in pressure is equal to or less than a predetermined value during predetermined period of time within the period from the time when a voltage source is turned on to the time when the cranking detecting means detects that the starter is on, and control means for controlling the first means to be opened and closed in response to the result of comparison between the atmospheric pressure detection value and the predetermined value.

Accordingly, if the amount change in the intake manifold pressure is equal to or less than the predetermined pressure in the predetermined period within the period from the time when the voltage source is turned on to the time when the cranking switch is on, the atmospheric pressure is detected by the pressure detecting means assuming that the intake manifold pressure is equal to the atmospheric pressure. When the engine idling is controlled, the atmospheric pressure detection value and the predetermined value are compared with each other to control the opening and closing of the bypass passage in accordance with the atmospheric pressure condition, whereby a cheap idling control apparatus can be provided.

The above-mentioned and still further objects and advantages will be fully understood by taking into consideration the following description with reference to the accompanying drawings wherein source embodiments are illustrated by way of example.

DESCRIPTION OF THE PREFERRED EMBODIMENTS

Figure 1:
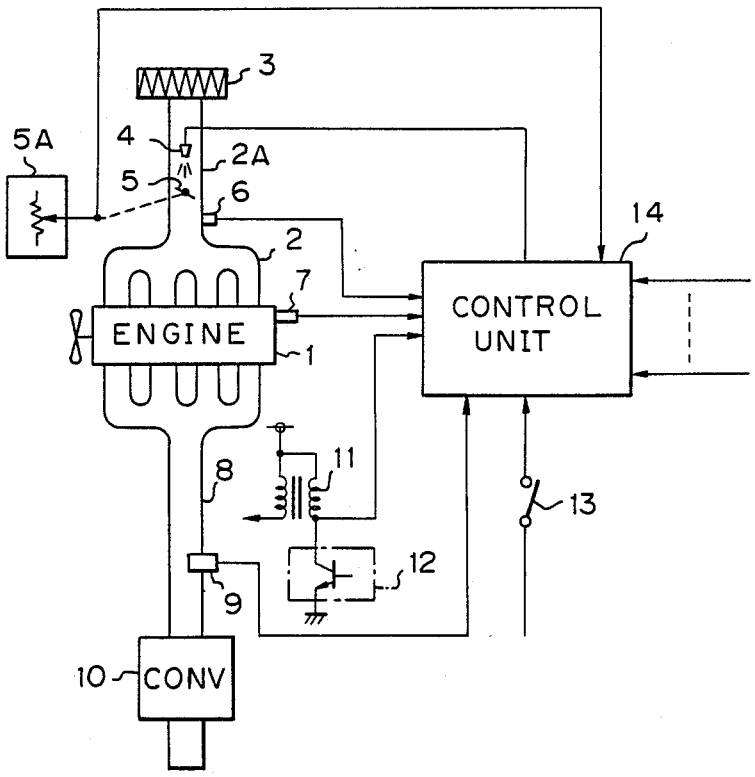
FIG. 1 is a schematical illustration of an arrangement realizing an engine control apparatus according to the present invention as a fuel supply control apparatus.

The first embodiment of an engine control apparatus according to the present invention will now be described with reference to FIGS. 1 to 6. FIG. 1 shows the arrangement of an embodiment realizing an engine control apparatus of the present invention as a fuel supply control apparatus, and in this drawing a conventional engine 1 mounted, for example, on a vehicle has an intake manifold 2. Connected to an upstream port of the intake manifold 2 is a suction pipe body 2A for constituting a suction pipe together with the intake manifold 2. The suction pipe body 2A is provided at its inlet port with an air cleaner 3, and fuel is injected and supplied from an injector 4 into the suction pipe body 2A. Also provided within the suction pipe body A2 is a throttle valve 5 for controlling the degree of opening of its suction passage to adjust the rate of suction of air to the engine 1. The degree of opening of the throttle valve 5 is detected by a throttle opening sensor 5A and is converted by appropriate means (a potentiometer type sensor, for example) interlocking with the throttle valve 5 to an analog voltage corresponding to the degree of opening of the throttle valve 5. Provided in the suction pipe body 2A downstream from the throttle valve 5 is a pressure sensor 6 for detecting the intake manifold pressure P in the form of the absolute pressure to provide a pressure signal having the magnitude corresponding to the detected pressure. The cooling water temperature WT for the engine 1 is detected by a cooling water temperature sensor 7. An exhaust manifold 8 of the engine 1 is connected with a fuel-to air ratio sensor 9 for detecting the oxygen concentration of the exhaust gas in the exhaust manifold 8 and is provided with a three way catalyst 10 for cleaning the exhaust gas. An ignition coil 11 for applying a high voltage to an ignition plug (not shown) of the engine 1 is energized when an igniter 12 is operated. A starter (not shown) driven for starting the engine 1 is operated by a cranking switch 13 for outputting ON or OFF signals. Various parameters obtained by detecting the operating conditions of the engine 1 as well as battery voltage $V_B$ are input into a control unit 14 which perform various decisions and arithmetic operations in response to such parameters and preset data, reads an atmospheric pressure detection value representing the atmospheric pressure and calculates the rate of fuel injection and so forth to effect control correspondingly.

Figure 2:
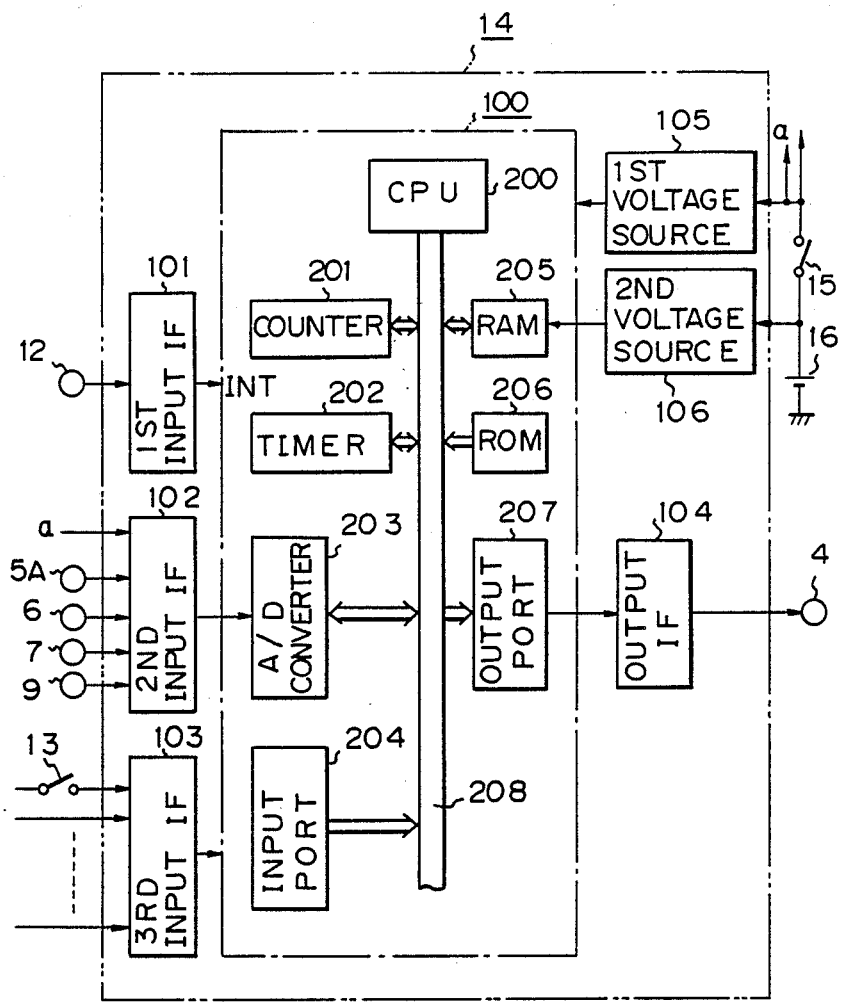
FIG. 2 is a block diagram of the construction of the control apparatus of FIG. 1.
Figure 3A:
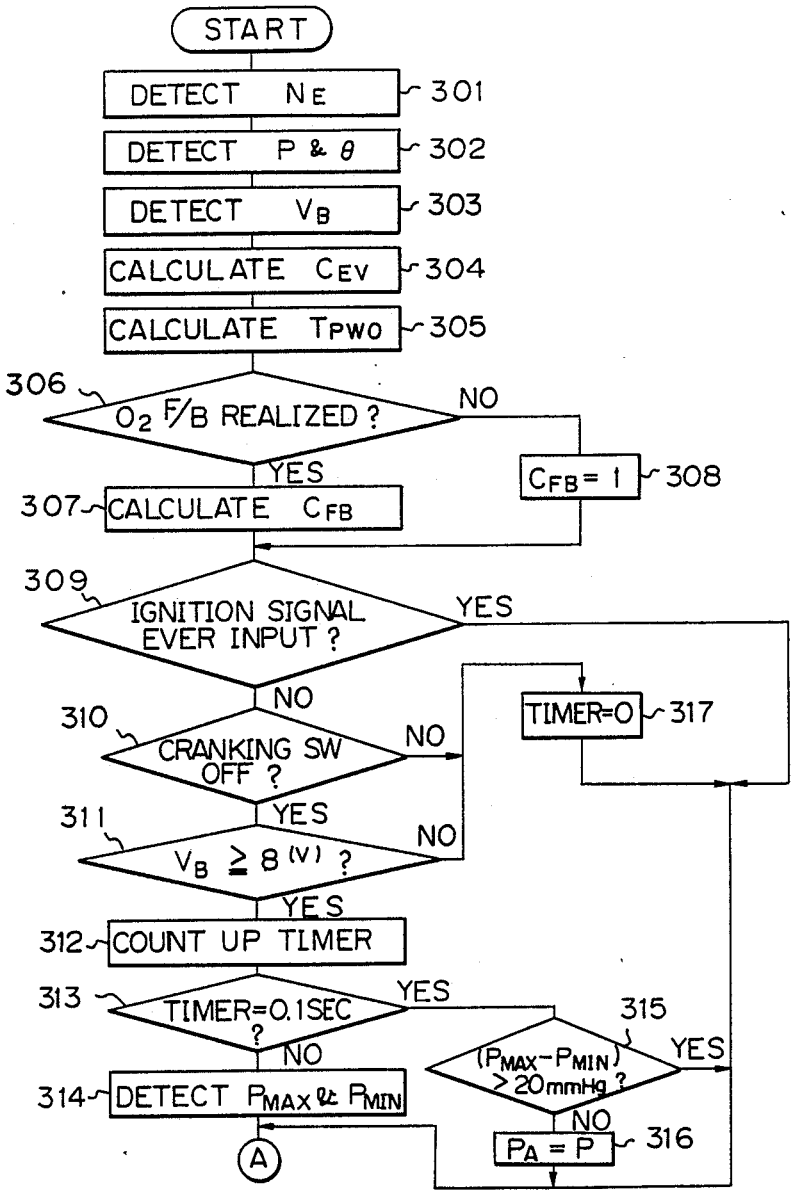
FIGS. 3*a* and 3*b* show a flow chart for explaining the fuel supply control operation of the control apparatus of FIG. 1.
Figure 3B:
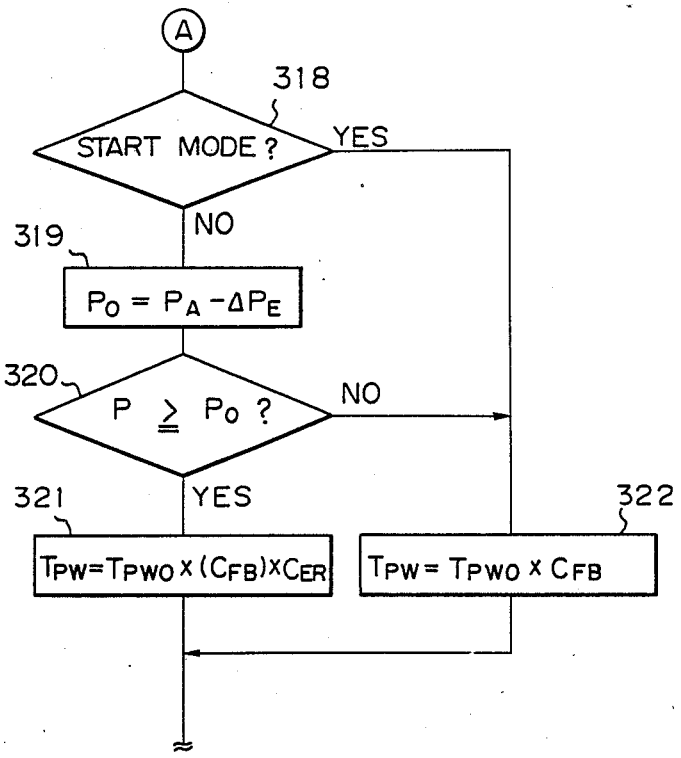

The internal structure of the control unit 14 will in more detail be described below with reference to FIGS. 2 and 3. In FIG. 2, the control unit 14 is provided with a microcomputer 100 which includes a CPU 200 for executing a flow shown in FIG. 3, a counter 201 functioning as a timer, a timer 202 for measuring the cycle of rotation of the engine 1, an A/D converter 203 for converting an analog signal to a digital signal, an input port 204 for inputting and transmitting the digital signal, a nonvolatile RAM 205 functioning as a work memory or the like, a ROM 206 for storing a flow shown in FIG. 3 in the form of a program and also storing data for comparison, decision and arithmetic operation, an output port 207 for providing an output for arithmetically operated rate of fuel injection, etc., and a common bus 208 for commonly connecting such components as mentioned above. The control unit 14 further includes a first input interface circuit 101 which is connected to the junction between an end of the primary coil of the ignition coil 11 and the collector of a transistor of the igniter 12 to input to the microcomputer 100 an ignition signal for detecting, for example, the engine rotational frequency $N_E$. Outputs of the throttle opening sensor 5A, pressure sensor 6, cooling water temperature sensor 7 and fuel-to-air ratio sensor 9 as well as an analog signal output from a battery 16 through a key switch 15 (which will be described below) are successively introduced into the A/D converter 203 through a second input interface circuit 102. The ON or OFF signal of the cranking switch 13 and other signals are input to the control unit 14 through a third input interface circuit 103. Connected between the output port 207 and the injector 4 is an output interface circuit 104. The positive terminal of the battery 16 the negative terminal of which is grounded is connected through the key switch 15 to a first source circuit 105 for supplying power to the microcomputer 100, and is also connected to a second power source circuit 106 for supplying power to RAM 205.

The operation executed by CPU 200 of the microcomputer 100 for deciding the rate of fuel injected to the engine 1 will be described below.

First, when the key switch 15 is turned on, the voltage from the battery 16 is applied to the first power source circuit 105. The first power source circuit 105 applies a constant voltage to the microcomputer 100 and the operation of the control unit 14 is commenced. Upon the commencement of operation, initialization is achieved, for example, to reset the timer on counter 201 to zero. With this commencement of operation, interruption is made for every predetermined period of time to repeatedly execute the flow of the interruption routine shown in FIGS. 3A and 3B.

At step 301, the engine rotational frequency $N_E$ is first calculated based on the measured data of the timer 202 measuring the rotational cycle of the engine 1 and then is stored in RAM 205. The timer 202 measures the period of time from the (m−1)-th time of ignition to the m-th time of ignition by receiving from the igniter 12 through the first input interface circuit 101 the ignition signal generated when the igniter 12 turns off. The measured data are stored in RAM 205 through a separate routine. At step 302, the pressure signal representing the intake manifold pressure P from the pressure sensor 6 and the throttle opening signal representing the throttle opening degree $\theta$ from the throttle opening sensor 5A are successively read through the second input interface circuit 102 and the A/D converter 203 and stored in RAM 205. At step 303, the voltage $V_B$ of the battery 16 is converted to a digital value by a process similar to that of step 302 and is read and stored in RAM 205. At step 304, the volumetric efficiency $C_{EV}$ of the engine 1 which experimentally obtained as a function of the engine rotational frequency and the intake manifold pressure based on the signals respectively representing the engine rotational frequency $N_E$ and the intake manifold pressure P read out of RAM 205 is calculated and stored in RAM 205. At step 305, the basic pulse width $T_{PWO}$ which is the basic time of fuel injection is calculated in accordance with the operation "K (constant)×P (intake manifold pressure)×$C_{EV}$(volumetric efficiency)", and the result thereof is stored in RAM 205. In the above operation, the value of the constant K is read out of ROM 206. At step 306, a decision as to whether or not the feedback conditions of the fuel-to-air ratio have been realized is made from the fact as to whether or not the fuel-to-air ratio sensor 9 is active, i.e., whether or not the output signal of the fuel-to-air ratio sensor 9 varies within a predetermined period of time (or from the level of the cooling water temperature WT detected by the cooling water temperature sensor 7). At step 307, if the ensure is YES at step 306, the feedback correction term $C_{FB}$ of the fuel injection time is calculated by proportional integration control corresponding to the output of the fuel-to-air ratio sensor 9 and is then stored in RAM 205. On the contrary, if the answer is NO at step 306, the routine proceeds to step 308 at which the correction term $C_{FB}$ is set to 1 in RAM 205.

After the process at step 307 or 308, the routine then proceeds to step 309. At this step, a decision is made as to whether or not the ignition signal from the igniter 12 has ever been inputed. If the ignition signal has never been input, the routine proceeds to step 310. At step 310, since the signal from the cranking switch 12 is input through the third input interface circuit 103 to the control unit 14, a decision is made as to whether or not the cranking switch 13 is on or off. If the cranking switch 13 is off, the routine proceeds to step 311 at which the battery voltage $V_B$ is read out of RAM 205 to decide whether or not this battery voltage $V_B$ is equal to or higher than 8 V. If the battery voltage $V_B$ is equal to or higher than 8 V, the routine proceeds to step 312 to count up the counter 201 and increase the time elapsed. Subsequent to step 312, the routine proceeds to step 313 at which a decision is made as to whether or not the time elapsed in the timer has become 0.1 sec, i.e., the count of the counter 201 has become a predetermined value. If the time of 0.1 seconds has not yet lapsed, the routine proceeds to step 314 at which the pressure signals representing the intake manifold pressure P are read out RAM 205 to detect the maximum and minimum values $P_{max}$ and $P_{min}$ which are in turn stored in RAM 205.

If the above-mentioned step 313 decides that the time elapsed is 0.1 sec, the routine proceeds to step 315 at which the pressure signals representing the maximum and minimum values $P_{max}$ and $P_{min}$ of the intake manifold pressure P are read out of RAM 205 to calculate the amount of pressure change $\Delta P(=P_{max}-P_{min})$ and then this amount of pressure change is compared with a predetermined pressure, for example, 20 mmHg. If said amount of pressure change $\Delta P$ is less than 20 mmHg, the routine proceeds to step 316 at which the pressure signal from the pressure sensor 6 representing the intake manifold pressure P is read and stored in RAM 205 as an atmospheric pressure detection value representing the atmospheric pressure $P_A$.

If step 310 decides that the cranking switch 13 is on, or if decides that the battery voltage $V_B$ is lower than 8 V, the routine proceeds to step 317 to reset the counter 201 to zero.

Figure 4:
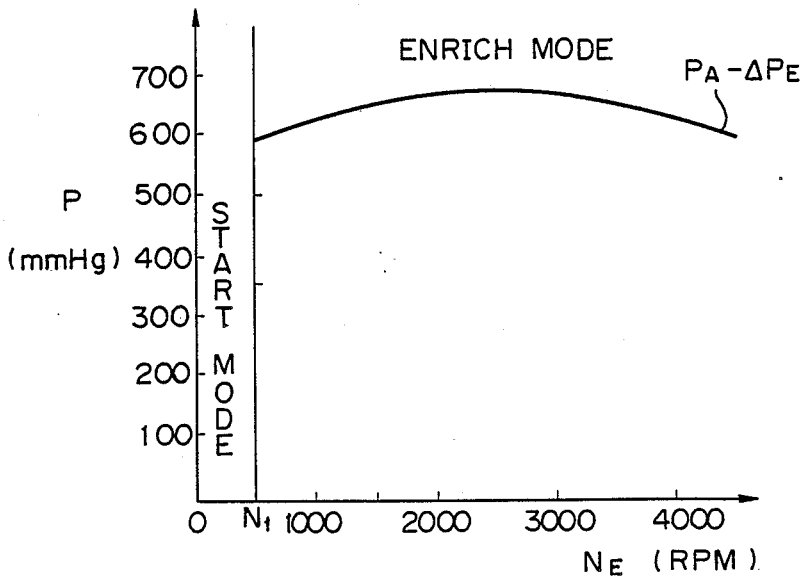
FIG. 4 is a graph for explaining the operational mode of the fuel supply control apparatus of FIG. 1.

If step 309 decides that the ignition signal has ever been input, the routine proceeds to step 318 either after the process at step 317, in the case where a decision that said amount of pressure change $\Delta P$ exceeds 20 mmHg is made at step 315 or after the process of step 316. At step 318, a decision is made as to whether or not the engine 1 is in the start mode. If the engine rotational frequency $N_E$ of the rotational frequency signal read out of RAM 205 is equal to or less than the engine rotational frequency $N_1$ shown in FIG. 4, step 318 determines that the engine 1 is in the start mode. If $N_E$ is larger than $N_1$, step 318 determines that the engine 1 is not in the start mode. In the event where step 318 decides that the engine 1 is not in the start mode, the routine proceeds to step 319 at which, after the atmospheric pressure detection value representing the atmospheric pressure $P_A$ is read out of RAM 205 and a set value corresponding to a predetermined pressure $\Delta P_E$ is read out ROM 206, the lower limit pressure $P_0$ of the enrich mode shown in FIG. 4 is calculated in accordance with the operational equation "$P_0=P_A-\Delta P_E$" to calculate the enrich mode pressure threshold value corresponding to the lower limit pressure $P_0$ of the enrich mode. At step 320 subsequent to step 319, a decision is made as to whether or not the intake manifold pressure P of the pressure signal read out of RAM 205 is equal to or higher than the lower limit pressure $P_0$ of the enrich mode, i.e., whether the engine 1 is in the enrich mode or not, if step 320 determines that the engine 1 is in the enrich mode, the pulse width $T_{PW}$ of the fuel injection is calculated at step 321 by multiplying the basic pulse width $T_{PWO}$ read out of RAM 205 by feedback correction term $C_{FB}$ (which is equal to 1 in the enrich mode) and by the enrich coefficient $C_{ER}$ in the enrich mode read out of ROM 206.

On the contrary, if step 318 determines that the engine 1 is in the start mode or if step 320 determines that the engine is not in the enrich mode but in an operation mode where the fuel-to-air ratio feedback control is possible, the routine proceeds to step 322 at which basic pulse width $T_{PWO}$ and the feedback correction term $C_{FB}$ are read out of RAM 205 and multiplied by each other to calculate the pulse width $T_{PW}$ of the fuel injection.

After processing at step 321 or 322, the routine proceeds to subsequent steps.

Although the engine rotational frequency is used to decide if the engine is in the start mode, a decision of the level of cooling water temperature may be added thereto.

Figure 5:
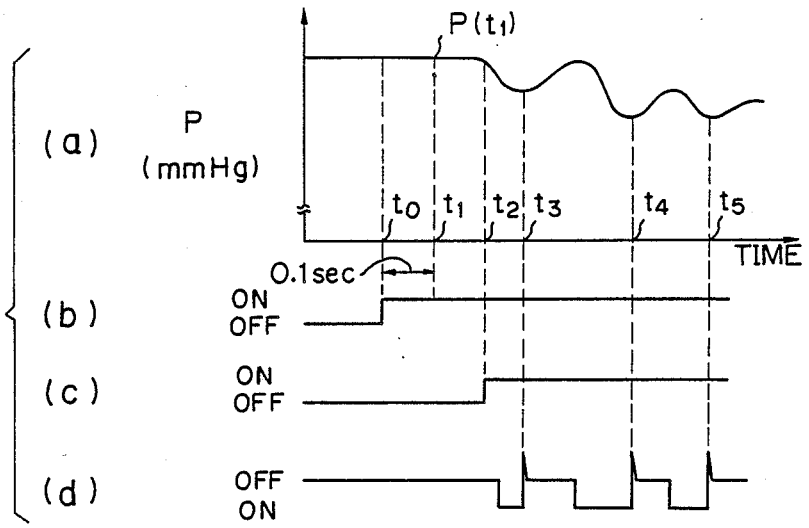
FIGS. 5(*a–d*) and 6(*a–d*) are diagrams for showing the operational timing of the fuel supply control apparatus of FIG. 1.
Figure 6:
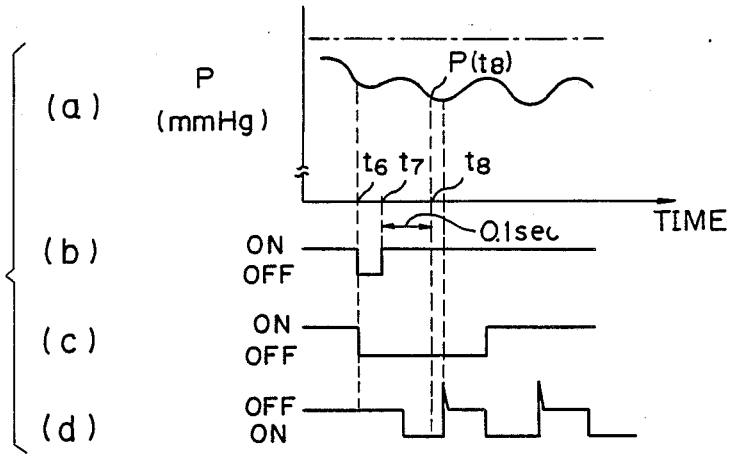

FIGS. 5 and 6 show the operational timing of the respective parts of the engine control unit of FIG. 1. In graphs (a) in these figures the abscissa designates time and the ordinate designates the intake manifold pressure P. The ON/OFF signal from the key switch 15 is shown at (b); the ON/OFF signal of the cranking switch 13 at (c) and the ignition signal from the igniter 12 at (d).

FIG. 5 shows a case where the pressure signal representing the atmospheric pressure $P_A$ is read from the pressure sensor 6 without any malfunction. At time to, the key switch 15 is turned on. During the period between time $t_0$ and time $t_1$ which is 0.1 seconds after time $t_0$, the cranking switch 13 is off and the ignition signals has never been input from the igniter 12. Therefore, the change in the intake manifold pressure P in this period of time is small and less than 20 mmHg, and thus the atmospheric pressure $P_A$ at point $P(t_1)$ at time $t_1$ is detected. At this time, the engine 1 is not yet rotated, no suction of air occurs no pressure loss is caused, allowing the detection error of the pressure to be extremely small. At time $t_2$ subsequent to time $t_1$, the cranking switch 13 is turned on and at this time the operation of the engine 1 is initiated. After time $t_2$, the engine 1 is rotating to repeatedly suck air through the air cleaner 3, the section pipe 2A and the intake manifold 2. At times $t_3$, $t_4$, $t_5$ and so forth, the ignition signals are generated and input to perform the explosion strokes, thereby repeating the known cycles of the engine 1. This causes the intake manifold pressure P to be changed significantly. Thus, in the event where the pressure change exceeds 20 mmHg at such time as after time $t_2$, or an ignition signal has ever input at such time as after time $t_3$, the detection error increases, and the pressure signal from the pressure sensor 6 is not used as an atmospheric pressure detection value. Since the period from time $t_1$ to time $t_2$ exceeds 0.1 seconds, the pressure signal is not used as an atmospheric pressure detection value.

FIG. 6 shows a case where the signal from the key switch 15 is temporarily turned off by a certain cause such as an instant shut off of the power source and then turned on again. Though the signal from the key switch 15 during rotation of the engine 1 is turned off at time $t_6$ and immediately thereafter again turned on at time $t_7$, the suction of air due to the running on of the engine 1 is repeated so that the intake manifold pressure P is a negative pressure significantly lower than the atmospheric pressure shown by a dash-and-dot line and has relatively large ripple changes. In this case, the cranking switch 13 is turned off at time $t_6$ and still off at time $t_8$ after the lapse of 0.1 seconds from time $t_7$. The ignition signals is not input at time $t_8$. Since the amount of change in the intake manifold pressure P exceeds 20 mmHg, however, the intake manifold pressure P at point $P(t_8)$ is detected, but not stored as an atmospheric pressure detection value.

Figure 7:
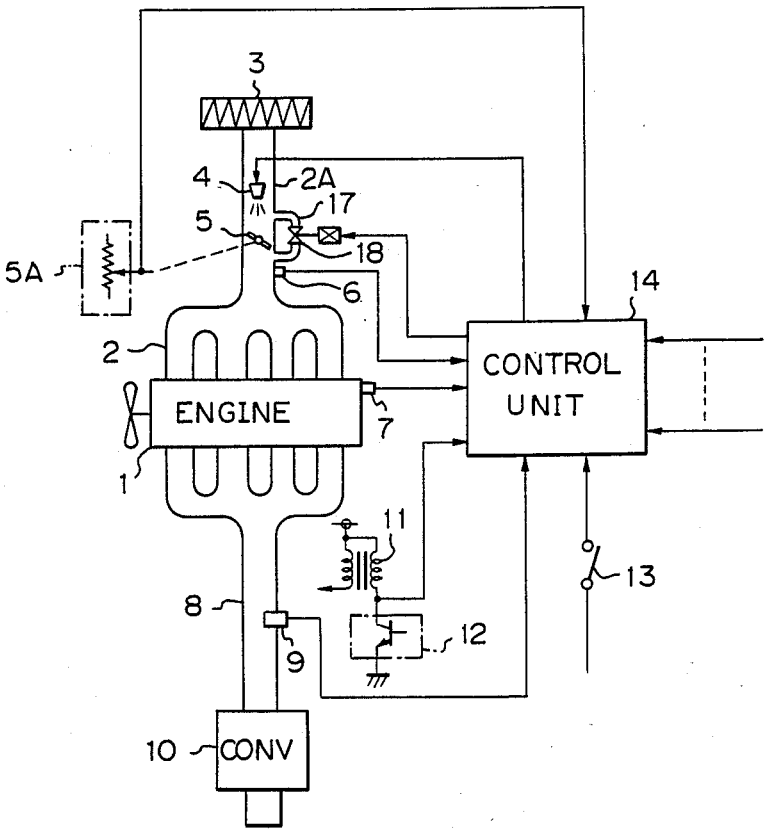
FIG. 7 is a schematical illustration of an arrangement realizing an engine control apparatus according to the present invention as an idling control apparatus.

The second embodiment of the present invention will be described below using FIGS. 7 to 9. FIG. 7 shows the structure of an idling control unit which is the second embodiment of the present invention. In this figure, components similar to those of the first embodiment are designated by the same reference numerals and the description thereon is omitted below.

In comparison with the first embodiment, the second embodiment differs in that the second embodiment additionally has a bypass passage 17 connected between the upstream and downstream sides with respect to the throttle valve 5 in the suction pipe body 2A to bypass the throttle valve 5 and a electromagnetic valve 18 provided in the bypass passage 17 for opening and closing thereof. The control unit 14 receives various parameters of the engine 1 as well as the battery voltage $V_B$ and operates to perform various decisions and arithmetic operations using prestored and preset data to control the injector 4 and the electromagnetic valve 18.

Figure 8:
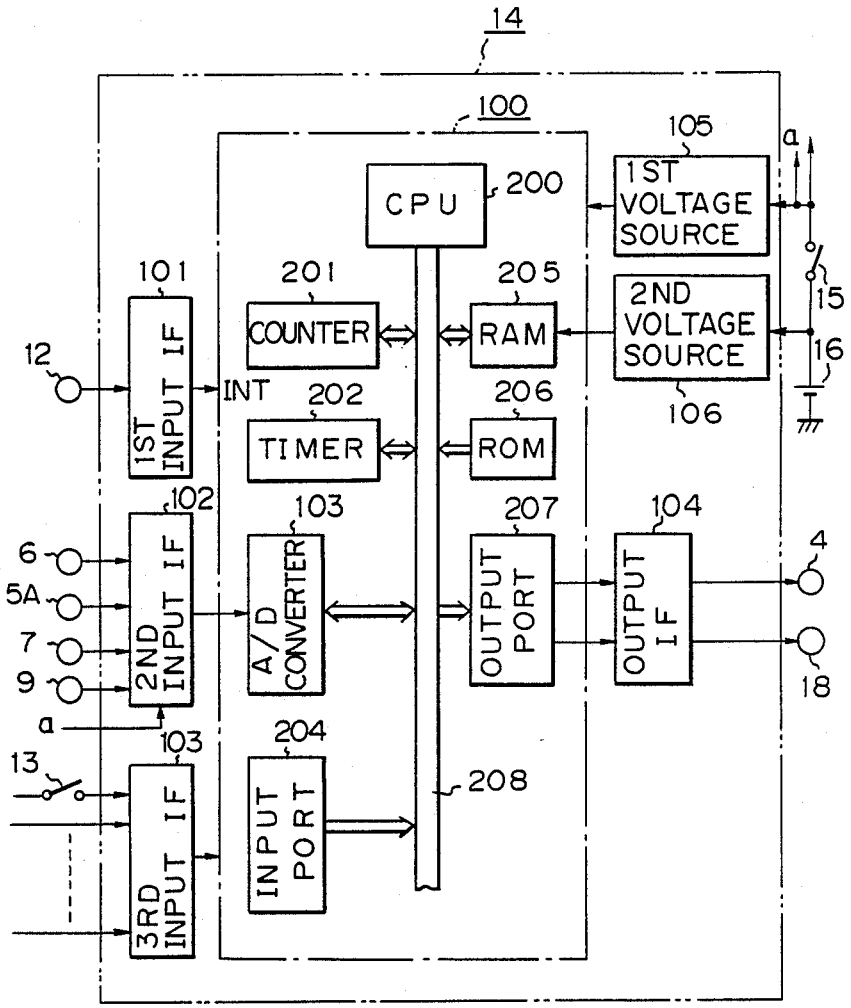
FIG. 8 is a block diagram showing the construction of the control apparatus of FIG. 7.
Figure 9A:
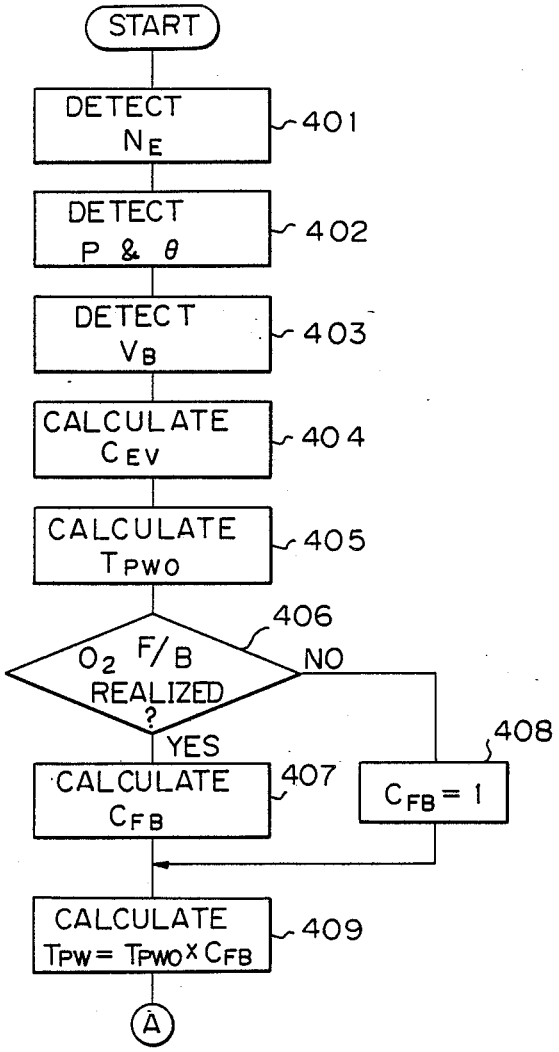
FIGS. 9A and 9B show a flow chart for explaining the operation of the idling control with the control apparatus of FIG. 7.
Figure 9B:
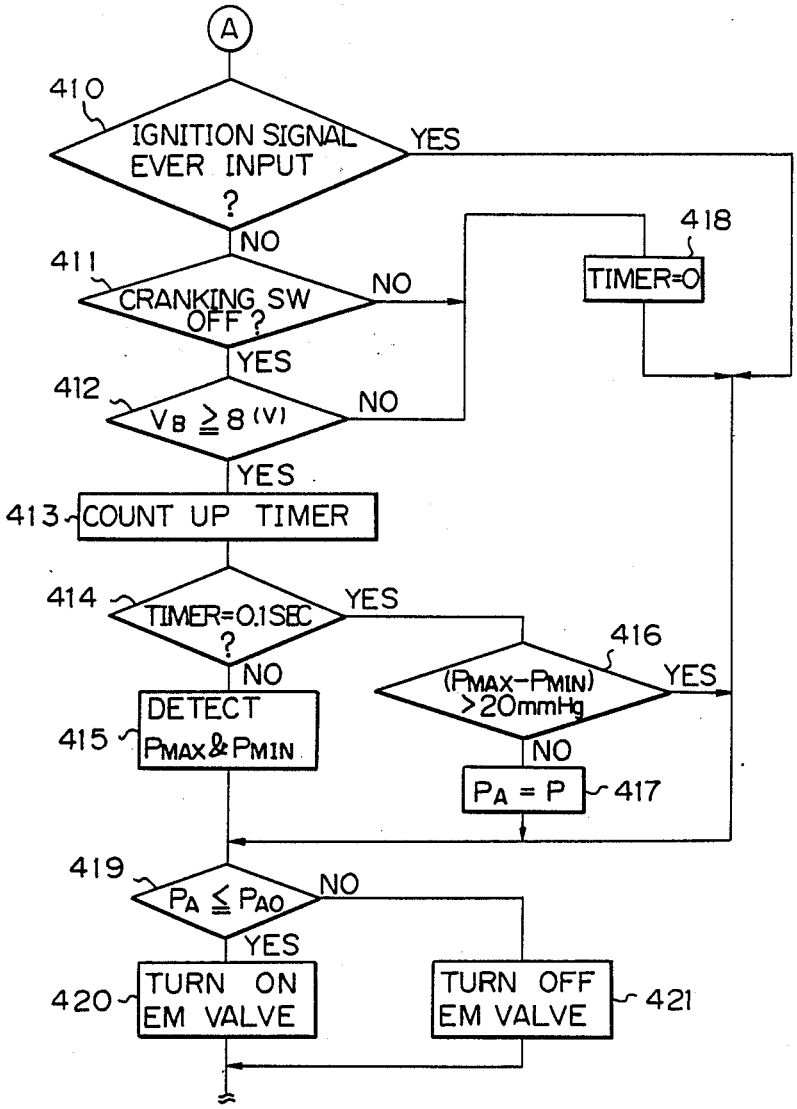

As shown in FIG. 8, the internal structure of the control unit 14 of the second embodiment is similar to that of the control unit of the first embodiment, except that the electromagnetic valve 18 is connected to the output interface circuit 104 which converts the output signals from the micro-computer 100 to pulses having the width corresponding to the rate of fuel injection as well as to ON/OFF signals to supply them to the injector 4 and the electromagnetic valve 18.

The operation will be described below. The external air from the air cleaner 3 is sucked, together with the fuel injected from the injector 4, corresponding to the opening of the throttle valve 5, through the suction pipe body 2A and the intake manifold 2 to the engine 1. When the electromagnetic valve 18 is on, the bypass passage 17 opens to allow the air and fuel to flow therethrough to the engine 1. After suction, the engine 1 performs the known operation cycles. Upon ignition, the igniter 12 is controlled to turn off so that a high voltage is applied by the ignition coil 1 to the ignition plug (not shown of the engine 1 for ignition. The exhaust gas passes through the exhaust manifold 8, is cleaned by the three way catalyst 10 and is discharged to the outside. The above-described operation is repeated and the engine 1 is rotated.

The operation executed by CPU 200 in the microcomputer 100 provided in the control unit 14 will be described below. First, when the key switch 15 is turned on, a voltage is applied from the battery 16 to the first power source circuit 105. The first power source circuit 105 then applies a constant voltage to the microcomputer 100 and the operation of the control unit 14 is commenced. Upon the commencement of operation, the initialization is achieved, for example, to reset the counter 201 functioning as a timer TM to zero. With this commencement of operation, the interruption is made for every predetermined period of time to repeatedly execute the interrpution routine flow shown in FIG. 9.

At step 401, the engine rotational frequency $N_E$ is first calculated based on the measured data of the timer 202 measuring the rotational cycle of the engine 1 and is then stored in RAM 205. The timer 202 measures the period of time from the (m−1)-th time of ignition to the m-th time of ignition by inputting from the igniter 12 to the first input interface circuit 101 the ignition signal generated when the igniter 12 turns off. The thus measured data are stored in RAM 205 through a separate routine. At step 402, the pressure signal representing the intake manifold pressure P from the pressure sensor 6 and the throttle opening signal representing the throttle opening degree $\theta$ from the throttle opening sensor 5A are successively read through the second input interface circuit 102 and the A/D converter 203 and are stored in RAM 205.

At step 403, the battery voltage $V_B$ is read from the battery 16 through the key switch 15, the second interface circuit 102 and the A/D converter 203 and is stored in RAM 205. At step 404, the volumetric efficiency $C_{EV}$ of the engine 1 determined by the intake manifold pressure P and the engine rotational frequency $N_E$ is calculated. At step 405, the basic pulse width $T_{PWO}$ of the rate of fuel injection is calculated in accordance with the operation "K (constant)$\times$P$\times C_{EV}$". At step 406, a decision as to whether or not the feedback conditions of the fuel-to-air ratio have been realized is made from the fact as to whether or not the fuel-to-air ratio sensor 9 is active (or from the level of the cooling water temperature detected by the cooling water temperature sensor 7). At step 407, if the feedback conditions have ben realized, the arithmetic operation of the feedback correction term $C_{FB}$ of the fuel injection time is made by proportional integration control corresponding to the output of the fuel-to-air ratio sensor 9. If no feedback condition has been realized, the correction term $C_{FB}$ is set to 1 at step 408. After the process at step 407 or 408, the routine then proceeds to step 409 at which the pulse width $T_{PW}$ of the rate of fuel injection is calculated in accordance with the equation "$T_{PW}=T_{PWO}\times C_{FB}$", and then stored in RAM 205.

After the process at step 409, the routine proceeds to step 410 at which a decision is made as to whether or not the ignition signal has ever been input. If not, the routine proceeds to step 411. At step 411, since the signal of the cranking switch 13 is input through the third input interface circuit 103 to the microcomputer 100, a decision is made as to whether or not the cranking switch 13 is off. If the cranking switch 13 is off, the routine proceeds to step 412 at which the battery voltage $V_B$ is read out of RAM 205 to decide whether or not this battery voltage $V_B$ is equal to or higher than 8 V. If the battery voltage $V_B$ is equal to or higher than 8 V, the routine proceeds to step 413 to count up the counter 201 and increase the time elapsed in timer TM. Subsequent to step 413, the routine proceeds to step 414 at which a decision is made as to whether or not the timer TM indicates that 0.1 seconds has elapsed, i.e., whether or not the count of the counter 201 has become a predetermined value. If 0.1 seconds has not elapsed, the routine proceeds to step 415 at which the pressure signals representing the intake manifold pressure P are read out of RAM 205 to detect the maximum and minimum values $P_{max}$ and $P_{min}$ which in turn are stored in RAM 205.

In the event where a decision that the timer TM has counted 0.1 sec is made at the above-mentioned step 414, the routine proceeds to step 416 at which the pressure signals representing the maximum and minimum values $P_{max}$ and $P_{min}$ are read out of RAM 205 to calculate the amount of pressure change $\Delta P(=P_{max}-P_{min})$ which is then compared with a predetermined pressure, such as 20 mmHg. If said amount of pressure change $\Delta P$ is less than 20 mmHg, the routine proceeds to step 417 at which the pressure signal from the pressure sensor 6 representing the intake manifold pressure P is read and stored in RAM 205 as an atmospheric pressure detection value representing the atmospheric pressure $P_A$.

If step 411 decides that the cranking switch 13 is on, or if step 412 decides that the battery voltage $V_B$ read out of RAM 205 is lower than 8 V, the routine proceeds to step 418 to reset the counter 201 to zero and thus reset the timer TM to zero.

Either after the process of said step 415, in the event that step 410 decides that the ignition signal has ever been input, after the process of said step 417 or 418, or in the event that step 416 decides that the amount of pressure change $\Delta P$ exceeds 20 mmHg, the routine proceeds to step 419 at which whether or not the atmospheric pressure $P_A$ is equal to or lower than a predetermined pressure $P_{AO}$. Namely, at step 419 the atmospheric pressure detection value representing the atmospheric pressure $P_A$ is read out of RAM 205 to decide whether or not the atmospheric pressure detection value is equal to or less than the value corresponding to the predetermined pressure $P_{AO}$. If the atmospheric pressure $P_A$ is decided to be equal to or lower than the predetermined pressure $P_{AO}$ at step 419, the routine proceeds to step 420 at which electromagnetic valve 18 is controlled to turn on through the output port 207 and the output interface circuit 104 to allow the bypass passage 17 to open. If the atmospheric pressure $P_A$ exceeds the predetermined pressure $P_{AO}$, the routine proceeds to step 421 to control the electromagnetic valve 18 to turn off, thereby closing the bypass passage 17.

In the second embodiment described above, the opening and closing of the bypass passage 17 are effective particularly in the idling state of the engine 1. In this state the throttle valve 5 is set at the idling opening degree and the bypass passage 17 is opened or closed by the electromagnetic valve 18 in response to the atmospheric pressure.

From said step 420 or 421, the routine proceeds to subsequent steps.

The descriptions made in relation to FIGS. 5 and 6 are also true to the second embodiment.

Although the present invention has been described in detail with reference to certain embodiments, various alterations and modifications can be made without departing from the spirit and scope of the invention. For example, in the described embodiments the amount of pressure change $\Delta P$ which is the difference between the maximum and minimum values $P_{max}$ and $P_{min}$ of the intake manifold pressure P is compared with the predetermined pressure, but it may be possible to compare with the predetermined pressure an amount of pressure change obtained by sampling the intake manifold pressure at every constant period of time. It may also be possible that the intake manifold pressure stored in RAM 205 at step 302 or 402 is used as an atmospheric pressure detection value.

What is claimed is:

1. An apparatus for controlling an engine including a key switch connected to a voltage source, a starter for starting the engine, an intake manifold for supplying a mixed gas of sucked air and fuel and a throttle valve for limiting the rate of suction of air, said apparatus comprising:

pressure detecting means provided at a suction passage downstream of said throttle valve for detecting the intake manifold pressure in the form of the absolute pressure;

cranking detecting means for detecting whether said starter is in the ON condition or not;

pressure change detecting means for detecting that the amount of change in pressure detected by said pressure detecting means is equal to or less than a predetermined value during a predetermined period of time within the period from the time when said voltage source is turned on to the time when said cranking detecting means detects that the starter is on; and memory means responsive to a detection signal from said pressure change detecting means for storing a pressure signal from said pressure detecting means as an atmospheric pressure detection value, whereby the engine is controlled in accordance with an output signal of said memory means.

2. An apparatus as set forth in claim 1, wherein said pressure change detecting means includes a second pressure detecting means for detecting and storing in said memory means the maximum and minimum values of the output signals of said pressure detecting means during said predetermined period when said cranking detecting means detects that said starter is off, means for reading said maximum and minimum values out of said memory means to calculate the difference therebetween, and means for comparing said difference with said predetermined value.

3. An apparatus as set forth in claim 2, wherein the rate of fuel injection to said engine is controlled on the basis of the output signals from said memory means.

4. An apparatus as set forth in claim 2, wherein a passage for bypassing said throttle valve is controlled to be opened or closed on the basis of the output signals from said memory means.

5. In an apparatus for controlling an engine including a key switch connected to a voltage source, a starter for starting the engine, an intake manifold for supplying a mixed gas of sucked air and fuel and a throttle valve for limiting the rate of suction of air, a fuel supply control apparatus for the engine comprising:

pressure detecting means provided at a suction passage downstream of said throttle valve for detecting the intake manifold pressure in the form of the absolute pressure;

cranking detecting means for detecting whether said starter is in the ON condition or not;

pressure change detecting means for detecting that the amount of change in pressure detected by said pressure detecting means is equal to or less than a first predetermined value during a predetermined period of time within the period from the time when said voltage source is turned on to the time when said cranking detecting means detects that the starter is on;

memory means responsive to a detection signal from said pressure change detecting means for storing a pressure signal from said pressure detecting means as an atmospheric pressure detection value; and enrich control means which decides that said engine is in the enrich mode to allow the rate of fuel supply to be increased if a pressure signal of said pressure detecting means is equal to or larger than the difference between the atmospheric pressure detection value and a second predetermined value when said engine is in a driving mode other than the start mode.

6. A fuel supply control apparatus as set forth in claim 5, wherein said pressure change detecting means includes a second pressure detecting means for detecting and storing in said memory means the maximum and minimum values of the output signals from said pressure detecting means during said predetermined period when said cranking detecting means detects that said starter is off, means for reading said maximum and minimum values out of said means to calculate the difference therebetween, and means for comparing said difference with said first predetermined value.

7. A fuel supply control apparatus as set forth in claim 6, wherein said enrich control means comprises decision means for deciding whether or not said engine is in the start mode on the basis of the engine rotational frequency, calculating means for calculating the difference between said atmospheric pressure detection value and said second predetermined value to obtain a pressure threshold value of the enrich mode when said decision means decides that said engine is not in the start mode, and comparing means for comparing the pressure in said intake manifold detected by said pressure detecting means with said pressure threshold value, whereby the rate of fuel injection is determined in accordance with outputs of said comparing means.

8. In an apparatus for controlling an engine including a key switch connected to a voltage source, a starter for starting the engine, an intake manifold for supplying a mixed gas of sucked air and fuel and a throttle valve for limiting the rate of suction of air, an idling control apparatus for the engine comprising:

bypass passage means for bypassing said throttle valve;

first means for opening and closing said bypass passage means;

pressure detecting means provided at a suction passage downstream of said bypass passage for detecting the intake manifold pressure in the absolute pressure;

cranking detecting means for detecting whether said starter is in the ON condition or not;

second means for storing a pressure signal of said pressure detecting means as an atmospheric pressure detection value if the amount of pressure change detected by said pressure detecting means is equal to or less than a first predetermined value during a predetermined period of time within the period from the time when said voltage source is turned on to the time when said cranking detecting means detects that said starter is on; and control means for controlling said first means to be opened or closed in accordance with the result of comparison between said atmospheric pressure detection value and a second predetermined value.

9. An idling control apparatus as set forth in claim 8, wherein said second means includes a second pressure detecting means for detecting the maximum and minimum values of the output signals from said pressure detecting means during said predetermined period when said cranking detecting means detects that said starter is on, calculating means for calculating the difference between said maximum and minimum values, first comparing means for comparing said difference with said first predetermined value, memory means responsive to said first comparing means for storing the pressure in said intake manifold detected by said pressure detecting means as said atmospheric pressure detection value, and second comparing means for comparing said atmospheric pressure detection value with a predetermined pressure value, whereby said first means is controlled in accordance with outputs of said second comparing means.

10. A method of controlling an engine comprising the steps of:

detecting and storing the pressure in an intake manifold at a suction passage downstream of a throttle valve during a predetermined period within the period from the time when a voltage source is turned on to the time when a starter is on;

obtaining the amount of change in said pressure;

comparing said amount of change in said pressure with a predetermined value;

reading said stored pressure as an atmospheric pressure detection value in the case where said amount of change is equal to or less than said predetermined value; and controlling said engine in accordance with said atmospheric pressure detection value.

11. A method of controlling a fuel supply for an engine comprising the steps of:

detecting and storing the pressure in an intake manifold at a suction passage downstream of a throttle valve during a predetermined period within the period from the time when a voltage source is turned on to the time when a starter is on;

obtaining the amount of change in said pressure;

comparing said amount of change in said pressure with a first predetermined value;

reading said stored pressure as an atmospheric pressure detection value if said amount of change is equal to or less than said first predetermined value;

deciding whether said engine is in the start mode or not so as to obtain the difference between said atmospheric pressure detection value and a second predetermined value if said engine is not in the start mode; and controlling the rate of fuel supply if the pressure in said intake manifold is equal to or larger than said difference.

12. A method of controlling the idling of an engine comprising the steps of:

providing a passage for bypassing a throttle valve;

detecting and storing the pressure in an intake manifold at a suction passage downstream of said throttle valve during a predetermined period within the period from the time when a voltage source is turned on to the time when a starter is on;

obtaining the amount of change in said pressure;

comparing said amount of change in said pressure with a first predetermined value;

reading said stored pressure as an atmospheric pressure detection value if said amount of change is equal to or less than said first predetermined value;

comparing said atmospheric pressure detection value with a second predetermined value; and controlling said passage to be opened and closed in accordance with the result of such comparison.

* * * * *